United States Patent [19]

Gerry

[11] 4,245,609

[45] Jan. 20, 1981

[54] MODULATED AC IGNITION SYSTEM

[76] Inventor: Martin E. Gerry, 13452 Winthrope St., Santa Ana, Calif. 92705

[21] Appl. No.: 970,647

[22] Filed: Dec. 18, 1978

Related U.S. Application Data

[63] Continuation-in-part of Ser. No. 812,919, Jul. 5, 1977, Pat. No. 4,128,811, and a continuation-in-part of Ser. No. 814,206, Jul. 11, 1977, Pat. No. 4,140,947, and a continuation-in-part of Ser. No. 814,457, Jul. 11, 1977, Pat. No. 4,139,804, and a continuation-in-part of Ser. No. 816,714, Jul. 18, 1977, Pat. No. 4,144,476, and a continuation-in-part of Ser. No. 868,118, Jan. 9, 1978, Pat. No. 4,168,692, and a continuation-in-part of Ser. No. 878,792, Feb. 17, 1978, Pat. No. 4,169,445, and a continuation-in-part of Ser. No. 913,437, Jun. 7, 1978, abandoned.

[51] Int. Cl.[3] ..... F02P 3/02; F02P 3/06

[52] U.S. Cl. ..... 123/594; 123/596; 123/598; 123/604; 123/620; 123/621; 123/651; 123/652; 123/653; 123/605

[58] Field of Search ..... 123/148 AC, 148 E, 148 CB, 123/148 B, 148 DS, 148 C, 146.5 A

[56] References Cited

U.S. PATENT DOCUMENTS

| | | | |
|---|---|---|---|
| 1,453,030 | 4/1923 | Ucar | 123/148 C |
| 2,997,552 | 8/1961 | Silverschotz | 123/146.5 A |
| 3,086,144 | 4/1963 | Short | 123/148 AC |
| 3,161,803 | 12/1964 | Knittweis | 123/148 E |
| 3,196,313 | 7/1965 | Quinn | 123/148 CB |
| 3,244,160 | 4/1966 | Carsten | 123/148 AC |
| 3,424,142 | 6/1969 | Nilssen | 123/148 E |
| 3,613,654 | 10/1971 | Gilbert | 123/148 E |
| 3,780,717 | 12/1973 | Rakitch | 123/148 AC |
| 3,841,287 | 10/1974 | Nielsen | 123/148 E |
| 3,908,622 | 7/1976 | Long | 123/148 E |

*Primary Examiner*—Charles J. Myhre
*Assistant Examiner*—R. A. Nelli

[57] ABSTRACT

An ignition system includes an alternating current power source which feeds a transformer having a primary winding, the primary winding being coupled to an electronic switch. The electronic switch intermittently interrupts current flowing in the primary winding and in the output circuit of the power source. Such electronic switch is made operable by virtue of the peak excursions of the alternating current thus supplying the necessary collector or emitter potential, depending upon the manner in which the electronic switch is connected, for the entire igniter firing cycle. A capacitor in series with the output circuit of the power source and with the primary winding enables current to be transferred out of the power source to such primary winding. Such electronic switch also provides discrete separation between successive output waveforms of successive ignition firing cycles. The system employs a temporary change accumulator inductor in the output circuit in series with the primary winding. Such charge accumulator inductor is an alternative fix for the deficiencies in the output transformer core of the alternating current power source conventionally used by transformer manufacturers for such power souces, so that when an appropriate magnetic core is utilized the output winding of the output transformer will provide sufficient temporary charge storage to obviate the need of such charge accumulator inductor.

11 Claims, 10 Drawing Figures

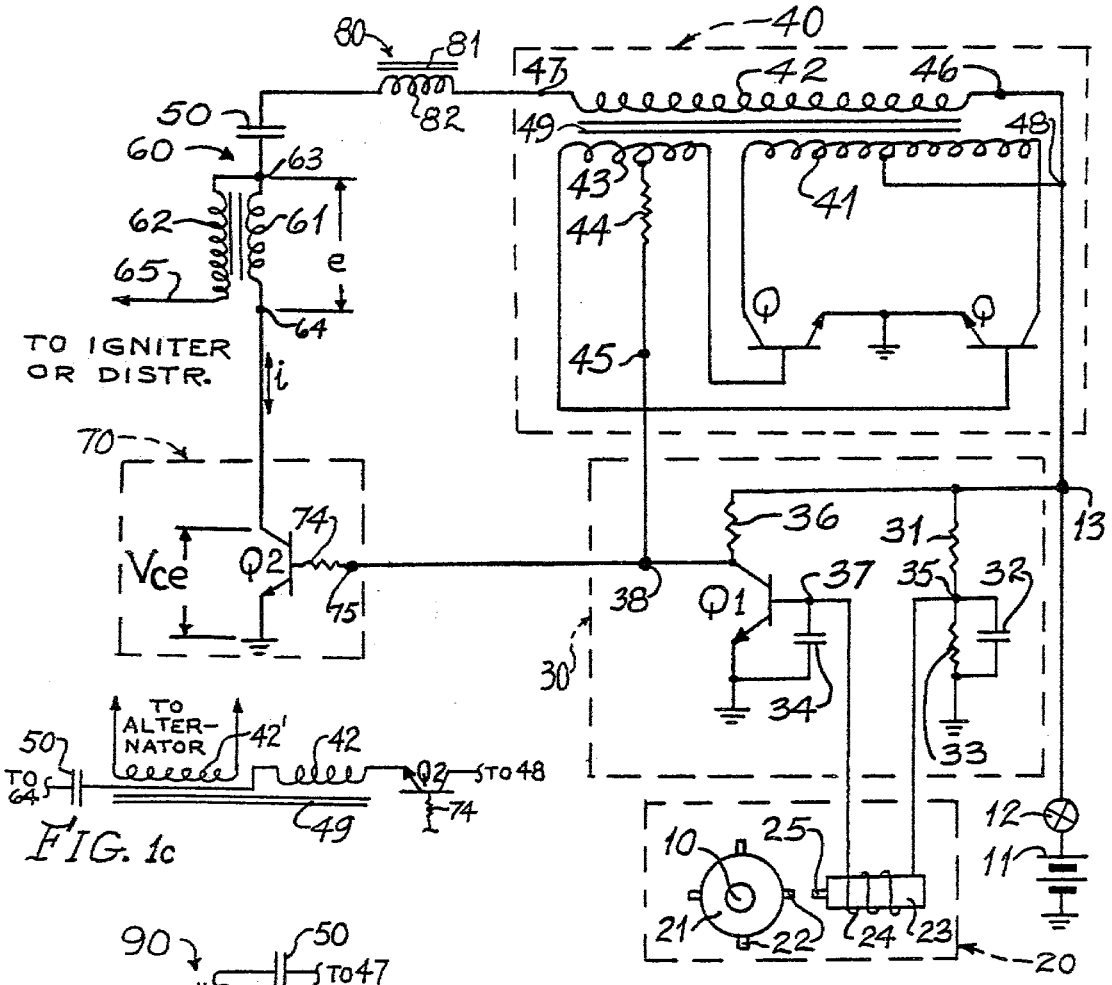
FIG. 1c
FIG. 1
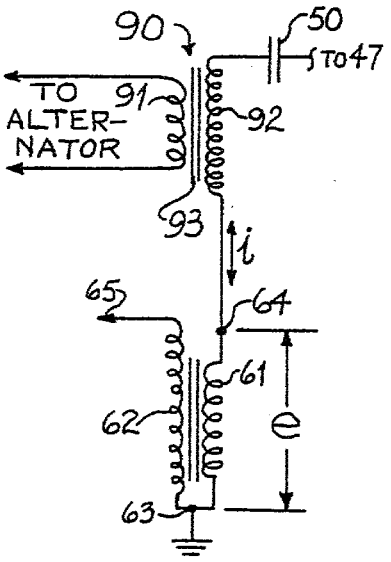
FIG. 1b
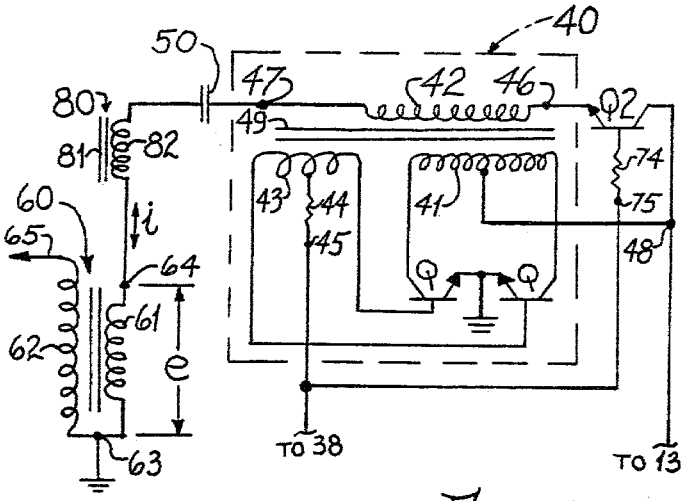
FIG. 1a

MODULATED AC IGNITION SYSTEM

CROSS-REFERENCE TO RELATED APPLICATIONS

This application is a continuation-in-part of copending applications Ser. No. 812,919 filed July 5, 1977 now U.S. Pat. No. 4,128,811, Ser. No. 814,206 filed July 11, 1977 now U.S. Pat. No. 4,140,947, Ser. No. 814,457 filed July 11, 1977 now U.S. Pat. No. 4,139,804, Ser. No. 816,714 filed July 18, 1977 now U.S. Pat. No. 4,144,476, Ser. No. 868,118 filed Jan. 9, 1978 now U.S. Pat. No. 4,168,692, Ser. No. 878,792 filed Feb. 17, 1978 now U.S. Pat. No. 4,169,445, and Ser. No. 913,437 filed June 7, 1978 now abandoned.

INCORPORATION BY REFERENCE

U.S. Pat. No. 4,122,815 issued Oct. 31, 1978, is incorporated by reference herein as though fully set forth, for the timing method disclosed therein. Such patent is owed by same applicant.

BACKGROUND OF THE INVENTION

This invention is in the field of ignition systems and more particularly in such systems that utilize alternating current as the principal power input to an ignition transformer.

Prior art systems generally involve the use of a keyed DC power source such as a battery in order to precharge the primary winding of an ignition transformer, and to subsequently discharge such primary winding into a capacitor so as create a transient current in the primary winding. Such system is generally referred to as the Kettering system, and suffers from a low energy level being fed to an igniter to fire same.

Other prior art systems, while utilizing AC power to feed such igniter, are unable to deliver a sufficiently high current to the ignition transformer primary winding or to the secondary winding thereof for feeding the igniters, and likewise suffer from low energy levels being delivered to the igniters.

Should the problem of low energy level ever be resolved, such prior art systems will still fail to perform satisfactorily when AC powered, since at higher power and energy levels, the waveforms of voltage and current during a firing cycle could not be accurately controlled as to their duration, and consequently successive firing cycles will produce waveforms without any discontinuities therebetween, resulting in pre-ignition of fuel in one of the engine cylinders before its appropriate time.

Additionally, the low energy problem solution by itself will not result in an effective ignition system since in addition to such higher energy, no system is available to provide large quantities of energy storage on a temporary basis for each igniter cycle and for delivery of such stored energy to help fire the igniter by means of a large quantity of arcs having a multitude of frequency components.

SUMMARY OF THE INVENTION

It is therefore an objective of this invention to provide a high power AC source which is automatically turned off between firing cycles, wherein the energy output of such system is substantially greater than any system employing the basic Kettering circuit.

It is also an objective of this invention to provide means for delivering higher current the AC power source to an ignition transformer primary winding and consequently delivering higher ignition energy levels.

It is a further objective of this invention to provide an electronic or other like switch, automatically triggered by a logic circuit, so that energy residual in the AC power source output circuit will be cut-off at substantially the same time when the AC power source is keyed to its off mode between ignition firing cycles, so that discrete discontinuities between voltage and current waveforms will prevail, and thus ignition timing could be aptly controlled to avoid pre-ignition firing in the engine firing chambers.

It is still a further objective of this invention to provide means for temporary energy storage and delivery to the system for each igniter firing cycle, and in furthering such objective to make use of proper magnetic cores for the several transformers utilized which the industry is not yet aware of their benefits, as well as to utilize power delivered by the automotive alternator in its AC form to feed and low frequency modulate the inventive ignition system.

Accordingly, an ignition system is provided having an AC power source and output means therein for delivering alternating current to such system. The alternating current may be of the rectangular waveform, triangular or saw tooth waveform, or sinusoidal.

A transformer having a primary winding coupled to the output means is provided to form the primary circuit. Switching means in the primary circuit is utilized so that when the power source is biased by means of a logic circuit to a quiescent state, the switching means acts to inhibit residual energy in a transformer of the power source from being transferred to the primary winding of the ignition transformer. Such switching means is enabled by virtue of the alternating current providing the requisite collector or emitter potential, depending upon the manner in which the switching means is connected, to enable such switching means to conduct without the need of the usual DC power feeding same. Such switching means may be an electronic switch, generally of the high power, and depending upon its location in the system may also have to be of the high voltage transistor category.

A capacitor utilized in the primary circuit enables power to be transferred to such circuit from the AC power source.

The oscillator stages of the AC power source may have Darlington type circuits that provide higher outputs than the conventional high power transitors by virtue of the high DC forward current amplification characteristics of such circuits. The switching means may also utilize a Darlington transistor circuit.

It is to be noted that the switching action of the switching means provides additional energy which intermodulates with the energy from the AC power source.

Logic means, coupled to the AC power source and to the switching means, provides substantially simultaneously, bias to the power source and to the switching means for turning on the AC power source as well as causing conduction in the switching means.

An inductor connected in series with the ignition transformer primary winding is utilized to temporarily store large quantities of charge and to deliver such charge to the ignition transformer and hence to the igniters for each igniter firing cycle. Such inductor has a magnetic laminated core made from cold rolled steel, relay steel, soft iron, silicon steel or mixtures or alloys thereof, which are generally used in low frequency power and audio transformers. Such core materials have low magnetic flux retention after delivery of the flux stored, so that the charged inductor readily delivers virtually all the charge therein and is ready for accepting more charge for the next igniter firing cycle.

Alternatively, a transformer made from the same core materials as herein stated, has one winding connected in series with the ignition transformer primary winding and the other winding is connected to the automotive alternator, which substantially serves a similar purpose as the storage inductor. However, such transformer being fed from the alternator could be replaced by an additional winding on the output transformer used in the power source which generates alternating current of the rectangular wave type for the system. Such output transformer presently is being made by manufacturers thereof with expensive and relatively ineffective magnetic cores, but if such output transformer were made using the inexpensive materials for the core as stated above, the output winding per se would act as the temporary flux storage inductor.

Various trigger circuits are provided, such as a magnetic pulse timer unit, cam actuated contactors, an electrically conductive disk with insulative members therein and a contactor, an optical timer, or a modulated oscillator, any one of which may be coupled to the logic means.

BRIEF DESCRIPTION OF THE DRAWINGS

FIG. 1 is a schematic of the ignition system utilizing magnetic pulse timing according to the invention.

FIG. 1*a* is a schematic of the same ignition system as in FIG. 1 except that the energy switching means control is located in a different part of the system's output circuit.

FIG. 1*b* is a schematic of the same system as in FIG. 1*a* except that the temporary energy storage means therein is also fed by an automotive alternator.

FIG. 1*c* is a schematic of the same system as in FIG. 1*a* except that the temporary energy storage means therein is in the form of an additional winding on the output transformer of the alternating current source fed by an automotive alternator.

DETAILED DESCRIPTION

Figure 2:
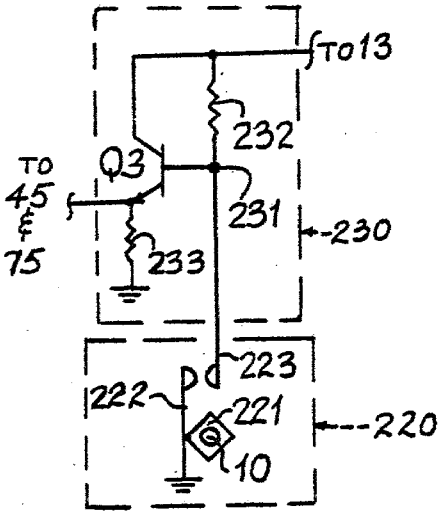
FIG. 2 is a schematic of the same system illustrated in FIGS. 1, 1*a*, 1*b* or 1*c*, but having cam actuated contactors used as the timer.

Referring to FIG. 1, a high voltage, high current and consequently a high energy ignition system comprises an alternating current power source, a capacitor and an ignition transformer. This system features an energy inhibit switch electronically controlled by a logic circuit, which logic circuit also substantially simultaneously turns on the alternating current source during the operative period of each firing cycle of the system and turns off the alternating current power source and the energy inhibit switch during the non-firing portions or quiescent periods of the system. The system also features the use of a temporary charge accumulator inductor to rapidly store charge and deliver charge stored to an ignition transformer primary winding. In FIG. 1, the logic circuit therein is triggered by a magnetic pulse timer.

In this specification, the conventional ground symbol is shown signifying either negative battery potential of battery 11, DC electrical return paths or AC electrical return paths, and hence such return paths and negative battery potential need not be referred to hereinbelow in explaining operation of the system.

Accordingly, battery 11, generally of the 12 volt type, provide DC power to the system through ignition switch 12 to make available such DC power at junction 13, and to feed DC power directly to logic circuit 30 and to alternating current power source 40.

Alternating current power source 40 is shown as a transistor type rectangular waveform generator, but it is to be understood that any alternating current source providing for example a saw tooth waveform, a triangular waveform or a sinusoidal waveform may be effectively used to effect this invention, in the circuits of FIG. 1 or in the circuits shown in other figures of this specification.

Magnetic pulse timer 20, conventional in the automotive field, consists of reluctance wheel 21 having regularly spaced ribs 22 at the wheel periphery, wherein wheel 21 and its ribs 22 are made of a suitable magnetic material and wherein such wheel is driven by distributor shaft 10 which is common to any automotive engine. Such timer employs permanent magnet 23 having a sensor winding 24 thereon. Magnet 23 has pole piece 25 at one end, so that when shaft 10 is driven by the engine, ribs 22 will interrupt magnetic flux lines between ribs 22 and pole piece 25, and induce a voltage in winding 24.

The magnetic timer may be designed with respect to the orientation of the north and south magnetic poles of magnet 23 as well as with respect to the direction of the turns of wire comprising winding 24, so as to provide either a leading negative or leading positive going pulse as an output of winding 24 when one of ribs 22 is driven past pole piece 25. The leading negative pulse design was adopted herein since this is conventional in the automotive industry, and accordingly the components of logic circuit 30 are tailored to recognize such timer pulse. The voltage output in the form of such pulse is fed to logic circuit 30.

Logic circuit 30 comprises a voltage divider consisting of resistors 31 and 33 having a capacitor 32 shunting resistor 33. Such voltage divider is connected to DC power at 13, and resistors 31 and 33 are chosen that a positive DC potential of about 1.2 volts appears at junction 35 to which one end of winding 24 is connected. Such logic circuit herein utilizes an NPN type transistor switch Q1 the collector of which is connected through resistor 36 to junction 13 so as to provide DC power to switch Q1. The other side of winding 24 is connected to the base of Q1, and such base has capacitor 34 connected between it and the emitter of Q1, which emitter is at ground potential. The function of capacitors 32 and 34 is to filter out and reject AC components riding on the gate pulse and initiated by winding 24 due to switching action of timer 20 then shaft 10 drives reluctor wheel 21. If desired, an additional capacitor, not shown, may be connected between junction 37 and the collector of Q1 for effecting additional rejection of such timer generated AC components. However, in this system, it may be an advantage to pass such timer generated AC components as they serve to modulate the gate or firing pulse at junction 38, thereby adding more firing energy by increasing the alternating current output from source 40 and by adding such components through switch 70 to the firing current in transformer 60. In such latter instance, capacitor 34 may be omitted. It is of course to be noted that it would be a simple matter to ulilize a PNP type as Q1 with appropriate changes in the rest of the circuit comprising logic circuit 30. Hence, junction 38 is the point in the system which will change in its potential to enable switching control of the alternating current source 40 and the energy inhibit switch 70.

Operatively, when shaft 10 is not being rotated or driven by the engine, no voltage is provided by winding 24 across junctions 35 or 37. Under such condition, the base of Q1 will be at a positive potential, sufficient to maintain Q1 in its ON mode, so that junction 38 will be at ground potential. In this case, DC current will flow through winding 24 to maintain the base of Q1 at a positive potential, thereby maintaining Q1 in its ON state, in which case the point at which resistor 36 is connected to the collector of Q1 and junction 38, is at ground potential thus causing the base of Q2 to be at ground potential as well as the bases of both Q s of source 40, thereby preventing source 40 from oscillating and Q2 form conducting.

When shaft 10 is driven, a pulse having a negative excursion, is induced across winding 24 at the time when one of ribs 22 is driven past pole piece 25, providing such negative going pulse to the base of Q1 at 37 and turning off Q1, thereby causing junction point 38 to be at positive potential, and under these conditions, turning on oscillator 40 by virtue of positive DC being applied to the bases of the Q s thereof, as well as by turning on switch Q2 by virtue of such same DC positive bias being applied to its base. The manner in which Q2 obtains its collector enabling voltage will be discussed below.

The following table shows the switching logic of the circuits of FIG. 1:

| Shaft 10 | Potential of Junction 37 | State of Q1 | Potential of Junction 38 | State of Q s | State of Q2 |
|---|---|---|---|---|---|
| at standstill | positive | ON | ground | OFF | OFF |
| being driven | negative | OFF | positive | ON | ON |

Since Q1 is generally a silicon device, it requires a base potential between 0.6 to 0.8 volts to maintain it in conductive state, and hence the +1.2 volts povided between junction 35 and ground, even considering the voltage drop in winding 24, will still maintain adequate voltage level at 37 within the stated limits for minimum sustaining voltage, so that Q1 will be in the ON state when shaft 10 is at standstill as well as when shaft 10 is driven but when ribs 22 are not opposite pole piece 25. In the ON state of Q1, junction 38 will be at ground potential thereby biasing the base of Q2 and the bases of the Q s to cause them to be non-conductive, or in their OFF states.

The divider network consisting of resistors 31 and 33 is chosen so that the voltage at junction 35 will be 1/10 th the battery voltage. Hence, if the battery or power source charging such battery is defective so that only 8 volts is provided by the battery, there will still be 0.8 volts at junction 35 which will be sufficient to maintain switching action of Q1 and operate logic circuit 30. Additionally, the manner in which winding 24 is connected in the logic circuit and the large capacitance of capacitor 32, permitted at its shown location, act to provide a stable source of input voltage to winding 24, and thereby provides a very reliable switching logic circuit.

When shaft 10 is driven and one of ribs 22 is driven past pole piece 25, a negative pulse will be induced in winding 24 which is between 1.5 and 2 volts in amplitude, thereby overcoming the positive bias of the base of Q1 and driving such base negative thereby cutting off current conduction between the collector and emitter of Q1, so that Q1 in switching to its OFF state, will cause junction 38 to be raised to a positive potential so as to turn on the Q s of power source 40 and Q2 of switch 70. The manner in which the Q s of source 40 turn on and off at a particular oscillating frequency or repetition rate is well known in the art and need not be discussed.

When power source 40 is turned on during each firing cycle, that is, each time one of ribs 22 is driven past pole piece 25, such source stays on for the duration when any portion of rib 22 is opposite any portion of pole piece 25, providing the firing gate or firing period at 38 to enable firing of an igniter in an engine, not shown. Power source 40 will keep on generating rectangular waves during such firing gate by virtue of Q1 being in its OFF state and consequently Q2 and the Q s being biased so as to cause Q2 to conduct during such firing gate period and the Q s to oscillate during such firing gate period. By virtue of rotation of wheel 21, when pole piece 25 is positioned between ribs 22, no firing gate is provided because there is absent the required negative going pulse as input at 37, so that Q1 is again biased sufficiently positive to switch it to its ON state thereby turning off Q2 and both Q s.

Power source 40 has as an integral part thereof a coupling output transformer the design of which controls the frequency or repetition rate of source 40. In this instance, a power source providing a 5 kilocycle rectangular repetition rate was utilized experimentally, the results of which will be discussed below. The output transformer has a center tapped primary winding 41 the ends of such winding being connected each respectively to the collectors of each of the Q s, and the emitters of these Q s being at ground potential in a common emitter configuration. The oscillator circuit utilizes Q s which are of the NPN type and preferably of the Darlington circuit configuration since such Darlington circuits will have inherently high current amplification characteristics which will provide high induced votage levels in primary 41. Feedback winding 43 is also center tapped and the ends thereof are respectively connected, one to each base of transistors Q, so as to provide magnetic coupling between windings 43 and 41 and a feedback voltage to maintain oscillation of power source 40. The center tap of winding 43 has bias resistor 44 connected thereto to set the bias current to the proper level for enabling source 40 to be pulsed ON each time junction 38 and consequently terminal 45 is at positive potential, and simultaneously to provide such positive pulse to junction 75 so as turn on switch 70. When junction 38 is at ground potential, circuits 40 and 70 will have their respective transistors in their OFF states.

It is pointed out that NPN Darlington transistors type 2N6284 made by Motorola were used experimentally as the Q s with excellent performance resulting. It is also to be noted that PNP Darlington transistors of type 2N6287 made by Motorola give similar excellent results. However, with the PNP type transistors, circuit 40 was modified so that the collectors were at negative battery or ground potential, and the emitters were at positive DC potential, and the logic circuit had to be modified to provide the ON and OFF modes discussed above which are compatible with required potentials for the bases of the PNP transistors. The transformer of source 40 has a secondary winding 42 which provides energy to an external load, such as capacitor 50 and primary winding 61 of transformer 60, as well as being an enabling means to initiate conduction in Q2 by providing thereto a series of positive potentials by virtue of the positive peaks of the waveform generated by circuit 40 during each firing cycle. It is to be noted that DC positive potential to the Q s is provided by virtue of the center tap of winding 41 being connected to junction 48. It is also to be noted that junction point 46 of winding 42 is connected to junction 48. It should also be pointed out that winding 42 at junction point 46 could have been connected to ground, if desired.

A temporary charge accumulator inductor 80 having a laminated core 81 and a coil 82 wound on core 81 is connected to terminal 47 of winding 42 at one end of coil 82 and to capacitor 50 at the other end of coil 82. Such accumulator inductor rapidly accumulates charge which it delivers through capacitor 50 to primary 61 of ignition transformer 60. This inductor makes up for the deficiencies found in the core 49 of the output transformer conventionally used by manufacturers of such transformers. Such cores as 49 are generally made of magnetic wound tape in torroidal form and are both expensive, fragile and have comparatively low flux density characteristics as compared with core 81 made of inexpensive laminations from cold rolled steel, relay steel, soft iron, silicon steel or mixtures or alloys thereof. Core type 81 is generally used for 60 cycle power transformers or in audio power transformers, and has between a 20 to 24 kilogauss flux density as compared with a maximum flux density of about 12 kilogauss for the tape-wound cores. Core type 81 also has other advantages over the tape-wound cores in that after a magnetization cycle, little or substantially no remnant flux remains in the core when inductor 80 is discharged of its flux, inapposite to tapewound cores which have a relatively high remanant flux. A core with little or no remanant flux used in the inductor will thus enable the inductor to take on more charge and deliver most of such new charge when called upon by the system. Consequently, inductor 80 as used had a one-inch-square cross-section area of the laminations and 75 turns of number 19 gage wire which provided the results as seen in FIGS. 8–10.

A capacitor 50 is provided and coupled to winding 81 of inductor 80 at one side, the other side of the capacitor being connected to common terminal 63 of ignition transformer 60. Here too, such other side of capacitor 50 could have been connected to terminal 64 of transformer 60 in which case terminal 63 would have been connected to the collector of Q2.

Capacitor 50 is the means for enabling current, and hence power, to be transferred from primary circuit winding 41 through secondary 42 to the load, in this case to transformer primary 61. Without such capacitor current i would not be present in sufficient quantity in primary winding 61, and consequently voltage e across primary 61 would be inadequate. Considering that the circuit comprising winding 42, primary 61 and reflected reactance of secondary 62 as well a the reactance of inductor 80, the capacitive reactance presented by capacitor 50 enables compensation of these inductive reactances resulting in an increased current i. The resonance principle cannot be used in its entirety to explain the phenomena involving the capacitor's compensation function, since resonance generally involves a single frequency and, consequently unlike here, unique reactance values, and in this system multiple frequencies are generated by power source 40 which involve a like number of different reactances. In any event, such capacitor 50 is selected by trying various values of capacitors until current i is at a maximum. Current i may be conveniently measured and observed by using a one-ohm high power resistor in the primary winding circuit, say between junction 64 and the collector of Q2, and measuring the voltage across such resistor by means of an accurately calibrated high frequency oscilloscope. Typical capacitor values will be in the order of between 0.2 to 1.0 microfarads.

Ignition transformer 60 was selected to have a turns ratio of 100, somewhat higher than stock automobile transformer turns ratios, since this will provide a greater voltage induced in secondary 62 and transferred to eighter an igniter or to a switching distributor by means of high voltage cable 65.

Circuit 70 has as its principal component, a high power, high voltage rated and high current rated power transistor Q2. Such transistor may typically be selected from the group of type 2N6251 made by RCA, type 2N6547 made by Motorola, type FT 359 made by Fairchild, or any of a series of Darlington type transistors made by Motorola of the MJ series such as MJ 10009. It is important not only to select a transistor for this purpose which will have a high collector current rating, but such transistor would also be able to withstand high collector to emitter voltages $V_{ce}$ developed in this part of the circuit. Bias resistor 74 of transistor switch Q2 is selected of sufficient ohomic value to limit the base current to a safe level within the rating limits of that transistor, and a resistor value is used that permits just enough base current to flow so as to enable Q2 to perform its switching function rapidly. Providing too much base current in Q2 by having too low an ohmic value for resistor 74 will slow down switching time of Q2 from its ON to its OFF state, and will tend to defeat the major purpose and use of switch 70.

In a high power system such as illustrated, which approaches 10 kilowatts of instantaneous power, separation of firing waveforms will be difficult by virtue of the fact that energy generated by source 40 and residual in its transformer windings, will tend to cause the current i to continue to flow after the Q s of circuit 40 are biased to their OFF states. Consequently, circuit 70 acts to assure rapid deprivation of energy feed to transformer 60 by inhibiting such residual energy from transfering to such transformer at the end of each igniter firing cycle. Such is accomplished in inhibiting current i flow at that time by interrupting such current flow in the output circuit by means of rapidly turning off Q2 at the same time as the Q s of source 40 are turned off. The penalty for not having such switch as Q2 in a high power unit is that pre-ignition firing will occur since the next-in-sequence igniter would be prematurely ignited by virtue of the current and voltage waveforms being continued beyond the required firing period.

A cursory examination of circuit 70, would seem to appear to indicate Q2 inoperability in view of no hard wire collector connection to a DC power source. However, as was previously mentioned, Q2 is enabled, that is the equivalent of such DC power is provided to the collector by the positive potential going peak excursions of the waveforms provided by AC source 40. The rate of such excursions, say in the order of between 2.5 and 10 kilocycles per second, though a 5 kilocycle per second rate was actually used, serves to maintain Q2 in its conductive mode throughout each and every igniter fire cycle.

A further benefit may be derived when a Darlington circuit type transistor such as an MJ 10009, MJ 10001 or an MJ 10005 by Motorola is chosen as the Q2 transistor. Such Darlington circuit is inherently a current amplifier, so that the current produced by the firing gate to trigger the base of Q2 to its ON state is amplified by Q2 and adds additional current to the current quantity in the primary winding. Such current injection feature increases the total current i, but it should be noted that since the current i increases, the voltage e across primary winding 61 will be increased by virtue of the increased current flow.

Another feature of the inventive system, including of course the variations of such system as discussed below in conjunction with the other system figures herein, is the quiescent state of power source 40 for about 25% of the system on-time. Inasmuch as Darlington circuits are used for the Q s, high AC currents circulate in their collector circuits in the ON modes of such Q s. Such high currents will contribute to high induced voltages in winding 42, and would normally require large heat sinks to dissipate the heat generated thereby. Since in this power generator, each of the Q s is in its ON state only half the time of each cyclic excursion of the AC current produced therein, and since each igniter firing period is less than one-half its non-firing period in time duration, triggering bias winding 43 in order to turn the Q s on and off, will permit the transistors to be maintained at relatively low operating temperatures because each of the Q s will in effect have a duty cycle of less than 25%. Further, switching such power source 40 to its ON mode will create a transient voltage at the beginning of each firing cycle which will be greater in amplitude than the voltage normally deliverable by such source 40, absent this type of switching.

It is pointed out that since primary 61, switch Q2, inductor 80, and winding 42 are in a series chain, it will make no difference in which connection order such components are connected, except that a special case is considered below in conjunction with the other figures where Q2 is located at a low impedance point in the output circuit, as therein discussed.

Referring to FIG. 1*a*, the system shown therein is identical to the system as discussed in FIG. 1, with the following differences.

Temporary charge accumulator inductor 80 is inserted between terminal 47 and one side of capacitor 50 by connecting winding 81 to terminal 47. The other side of winding 81 is connected to terminal 64 of primary 61 of ignition transformer 60, and common junction terminal 63 of primary 61 and secondary 62 of such ignition transformer is at ground potential. Charge accumulator inductor 80, made of the same materials discussed in connection with FIG. 1, also provides simular results as discussed above.

Switch Q2 has its emitter connected to junction 46 of winding 42 and its collector to junction 48 and consequently to terminal 13 at which terminal, DC positive potential is supplied to the collector of Q2. However, although Q2 collector is now hard-wired to a positive DC terminal, the emitter thereof is not hard wired to ground. Analogous to the discussion in connection with FIG. 1 as to how the Q2 energy inhibit switch is enabled, in this configuration, the negative peak excursions of the waveforms provided by AC source 40 to the emitter is the equivalent of a ground potential, thereby maintaining Q2 in its conductive mode throughout each and every igniter fire cycle. There is some benefit in connecting Q2 as shown when its current amplification factor is not essential, because here the resultant collector to emitter voltage would be lower than in the case of FIG. 1, and hence the collector to emitter voltage rating of Q2 may be substantially reduced.

Referring to FIG. 1*b*, the configuration is the same as FIG. 1*a* except that transformer 90 replaces inductor 80. Herein, the other side of capacitor 50 is connected to one end of secondary winding 92 of transformer 90, the other end of winding 92 being connected to terminal 64 of primary 61 of ignition transformer 60. Primary winding 91 of transformer 90 is connected to an alternator output normally obtained from the automotive alternator at its AC output terminals to feed winding 91 with a low frequency AC current which modulates the alternating current provided by winding 42 of source 40. Such added modulation has the effect of increasing the current i but will decrease the voltage e across winding 61, as compared with FIG. 1*a* configuration employing inductor 80. The net result though is to increase the energy delivered by the system as compared with the situation when neither inductor 80 or transformer 90 is used. Transformer 90 is made of the same core materials as used for inductor 80, and windings 91 and 92 are of such proportion so as to obtain a turns ratio that will provide at least 6 volts RMS across winding 92, when winding 91 is energized by the automotive alternator.

Referring to FIG. 1*c*, the system therein is the same as in FIG. 1*a* configuration except that instead of using a separate inductor such as 80 or a separate transformer such as 90, an additional winding 42' is provided on core 49 of the transformer of circuit 40. Such additional winding may have about the same number of turns of the same gage wire as used for inductor 80, and such winding 42' is connected to the automotive alternator to receive somewhere between 6 and 14 volts RMS of low frequency power normally provided by such alternator so as to modulate the power normally furnished by winding 42 of source 40. Of course, in such instance, core 49 would have to be made of the same materials and be of about the same cross-section area as used in inductor 80. The result would be increased current levels i at the expense of a decrease in voltage e across primary 61, as compared with the FIG. I*a* configuration.

Referring to FIGS. 1 and 1*a*, it should be noted that with a different transformer in source 40, than normally used by the industry, the benefits of increased voltage provided by inductor 80 and the increased current provided by transformer 90 can be obtained. The reason for the current decrease with use of inductor 80 is that an additional impedance is introduced in the output circuit of the system which is in series with primary winding 61. Conversely, the voltage decrease is probably due to the fact that transformer 90 would exhibit too great a voltage from across winding 92 considering the reflected impedance therein of winding 91. Accordingly, if such output transformer as used in circuit 40 utilized the laminated core used in making inductor 80, the detriments above mentioned would be avoided and both a high voltage e and a high current i would be obtained. In such instance, winding 41 would have 10 to 12 turns center-tapped of number 16 gage wire, winding 43 would have 2 turns center-tapped of number 18 gage wire, and winding 42 would have anywhere between 70 and 120 turns of number 19 or 20 gage wire, the range in number of turns depending upon whether higher currents i or higher voltages e were desired. Such windings would be wound on the core materials specified in connection with inductor 80, wherein the core laminations were stacked on each other until at least a one-inch cross-section of core was obtained within the axis of an insulating bobbin upon which windings 41, 42 and 43 were wound. The resultant structure therefore obtained in this instance would be usable for example in FIG. 1 with terminal 47 connected to one side of capacitor 50 and the other side of such capacitor being connected to terminal 63 of transformer 60, or with terminal 47 being connected to one side of capacitor 50 and the other side of such capacitor being connected to terminal 64 of transformer 60. Such transformer replacing the transformer in source 40 would of course be usable in FIGS. 1*a*, 1*b* and 1*c*.

Referring to FIGS. 1, 1*a*, 1*b* and 1*c*, an ignition system shown therein comprises the combination of an AC power source, a capacitor, an ignition transformer, switching means and a charge accumulation inductor.

AC power source 40 has an output transformer having windings 41, 42 and 43. Output means or winding 42 of the output transformer provides alternating current to the system. Capacitor 50 is connected in series with output means 42 and in series with primary winding 61 of ignition transformer 60. Output means 42, capacitor 50 and primary winding 61 comprise an output circuit. Switching means 70 is connected to the output circuit for intermittently interrupting current flow in the output circuit. Power source 40 also constitutes means for enabling current conduction through switching means 70. Charge accumulation inductor 80 is connected in series with the output circuit.

The output transformer may have a plural number of windings 41, 42, 43 and 42'. Winding 42' may be fed by alternating current that is different from the alternating current provided by output means 42.

An auxilliary transformer 90 may be used, having a pair of windings 91 and 92 wherein one of the windings 92 is connected in series with the output circuit and the other of the windings 91 is fed by alternating current which is different from the alternating current provided by the output means 42.

Referring to FIG. 2, the system illustrated is identical to the systems as discussed in connection with FIGS. 1, 1*a*, 1*b* or 1*c*, except that trigger means 20 is replaced by trigger means 220 and logic circuit 30 is replaced by logic circuit 230.

Trigger means 220 is a conventional cam actuated pair of contactors wherein engine distributor shaft 10 drives cam 221, the high portions of which cause the cessation of cooperation between contactors 222 and 223. When the high portions of cam 221 are not in cooperation with contactor 222 such contactor will cooperate with contactor 223. Contactor 223 is connected to junction 231 of logic circuit 230, which junction is also the base of transistor switch Q3. Resistor 232 provides a DC positive potential to junction 231 when contactor pair 222-223 are open, and thus enables base current in Q3 to flow. When contactor pair 222-223 are closed, junction 231 is at ground potential. The collector of Q3 is connected to the DC positive terminal of battery 11 by virtue of its connection to junction 13. The emitter of Q3 is connected through resistor 233 to ground.

Thus the switching logic of circuit 230 may be summarized by the following table:

| Contactor Pair 222–223 | Potential at Junction 231 | State of Q3 | Potential at Q3 Emitter | State of QS | State of Q2 |
|---|---|---|---|---|---|
| closed | ground | OFF | ground | OFF | OFF |
| open | positive | ON | positive | ON | ON |

Hence, when cam 221 causes contactors 222-223 to cooperate, the base of Q3 is biased at ground potential, collector current does not flow in Q3 and Q3 does not conduct. When cam 221 cuses contactor pair 222-223 to open, ground is removed from junction 231 and base current flows in Q3 and Q3 conducts thereby providing positive DC potential at the emitter thereof. Such emitter positive potential enables Q2 and the Q s to be biased DC positive and to conduct. When Q3 does not conduct, the emitter thereof will be at ground potential due to lack of collector current, thereby causing Q2 and the Q s to be turned off due to the ground potential provided at their respective bases.

Thus it can be seen that the logic circuit and the timer as herein illustrated may be utilized in the circuits of FIGS. 1, 1*a*, 1*b* or 1*c* instead of the timers shown therein, and yet maintain all the same functions and operations of the system as discussed in connection with FIGS. 1, 1*a*, 1*b* or 1*c*.

Figure 2A:
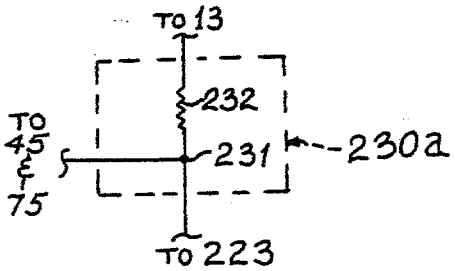
FIG. 2*a* is a schematic of the same system illustrated in FIG. 2 except that the transistor switch used in FIG. 2 is eliminated.

Referring to FIG. 2*a*, the system therein is the same and obtains the same results as in the case of FIG. 2, except that switch Q3 and resistor 233 are eliminated. Accordingly, all other connections are the same as discussed for FIG. 2 except that herein junction 231 is connected directly to junctions 45 and 75 of the system.

Figure 3:
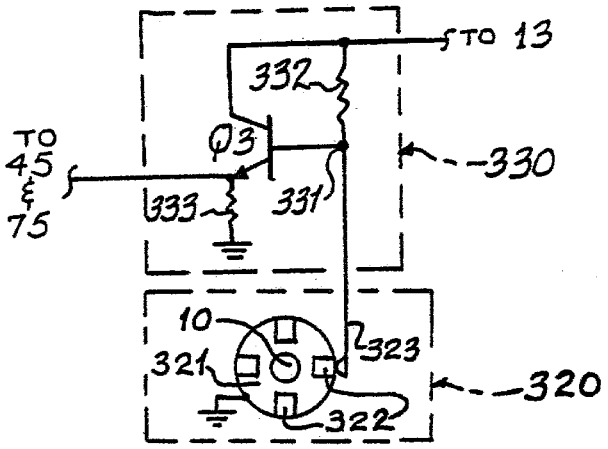
FIG. 3 is a schematic of the same system illustrated in FIG. 1, 1*a*, 1*b* or 1*c*, but having a driven wheel and contactor assembly acting as the timer.

Referring to FIG. 3, the system illustrated is identical to the system as discussed in connection with FIG. 2, except for trigger means 20 being replaced by trigger means 320 and logic circuit 30 being replaced by logic circuit 330.

Logic circuit 330 is identical in structure and function to logic circuit 230 described in connection with FIG. 2. In circuit 330, junction 331, resistor 332 and resistor 333 are respectively identical to junction 231, resistor 232 and resistor 233 of FIG. 2.

Trigger means 320 employs an electrically conductive disk 321 attached to and driven by shaft 10 of the engine. The shaft being at ground potential will electrically ground disk 321. Disk 321 has a plural number of electrically insulative members 322 regularly spaced at the periphery of the disk within the disk confines. The number of members 322 will be equal to the number of igniter circuits as provided by a high voltage distributor, not shown but conventional. Here, four igniter circuits and corresponding four igniters, one for each of the four engine cylinders, is assumed. Contactor 323 is connected to junction 331 and is in cooperation with the periphery of the disk. Consequently, when insulative member 322 is in cooperation with contactor 323, the base of Q3 being at the same potential as junction 331, is biased with a DC positive potential and Q3 conducts thereby providing a positive potential at its emitter and consequently providing such positive bias to junctions 45 and 75 thereby turning on Q2 and the Q s to perform the functions as hereinabove described in connection with FIGS. 1, 1*a*, 1*b* or 1*c*. *When contactor 323 is in cooperation with the metallic or conductive portion of disk 321, junction 331 is at ground potential, Q3 does not conduct, and junctions 45 and 75 are at ground potential, thereby turning off Q2 and the Q s.*

The following logic table is applicable to show the logic of FIG. 3 configuration:

| Contactor 323 in Cooperation With | Potential at Junction 331 | State of Q3 | Potential at Q3 Emitter | State of Q s | State of Q2 |
|---|---|---|---|---|---|
| metallic portion of disk 321 | ground | OFF | ground | OFF | OFF |
| member 322 | positive | ON | positive | ON | ON |

Figure 3A:
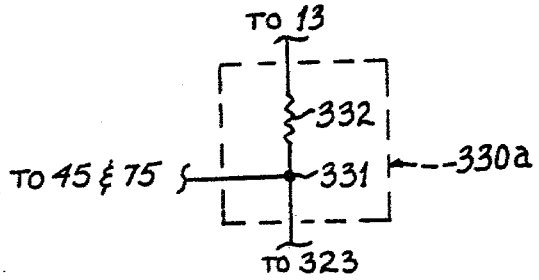
FIG. 3*a* is a schematic of the same system illustrated in FIG. 3, except that the transistor switch used in FIG. 3 is eliminated.

Referring to FIG. 3*a*, the system therein is the same and obtains the same results as in the case of FIG. 3, except that switch Q3 and resistor 333 are eliminated. Accordingly, all other connections are the same as discussed for FIG. 3 except that herein junction 331 is connected directly to junctions 45 and 75 of the system.

Figure 4:
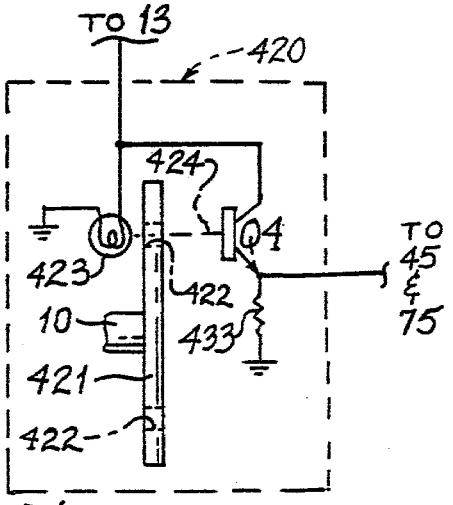
FIG. 4 is a schematic of the same system illustrated in FIGS. 1, 1*a*, 1*b* or 1*c* but having an optical timer.

Referring to FIG. 4, the system illustrated is identical to the system as discussed in connection with FIG. 1, 1*a*, 1*b* or 1*c*, except that trigger means 20 and logic circuit 30 are replaced by an optical trigger logic circuit 420.

Circuit 420 comprises a disk 421 driven by distributor shaft 10. Disk 421 has apertures 422 regularly spaced in the disk at the periphery thereof. Powered illumination means 423 is provided at one face of disk 421 for optically intermittently illuminating the base of an optically sensitive transistor Q4 by means of a light beam 424 passing through such apertures 422 to turn Q4 on each time light beam 424 impinges on the base of Q4 and thereby causes the emitter of Q4 to rise to a positive DC potential by virtue of collector current flowing in Q4. When light beam 424 is blocked by the opaque portion of disk 421, Q4 is off and no collector current flows in Q4, and consequently the potential at either end of resistor 433 is the same, namely ground potential. Hence, when Q4 is in its OFF state, junctions 45 and 75 will be at ground potential maintaining Q2 and the Q s in their OFF states. On the other hand, when Q4 is in its ON state, junctions 45 and 75 will be at positive DC maintaining Q2 in its ON state and the Q's in their oscillatory modes.

The following logic table is applicable to show the logic of the FIG. 4 configuration:

| Light Beam 424 | State of Q4 | Potential at Q4 Emitter | State of Q s | State of Q2 |
|---|---|---|---|---|
| blocked by disk 421 | OFF | ground | OFF | OFF |
| passes through aperture 422 | ON | positive | ON | ON |

Figure 5:
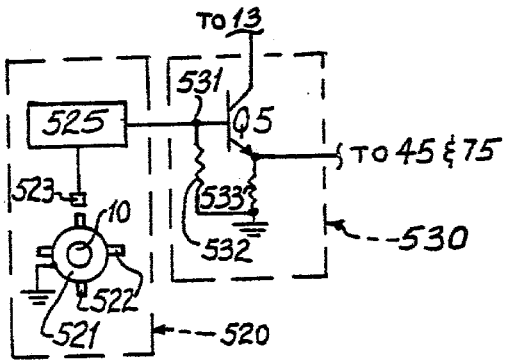
FIG. 5 is a schematic of the same system as illustrated in FIGS. 1,1*a*, 1*b*, or 1*c* but having a modulated oscillator acting as the timer.

Referring to FIG. 5, the system illustrated is identical to the system as discussed in connection with FIGS. 1, 1*a*, 1*b* or 1*c*, except that trigger means 20 is replaced by trigger means 520, and logic circuit 30 is replaced by logic circuit 530.

Trigger means 520 employs an angular modulated oscillator wherein oscillator 525 is modulated by virtue of a variable capacitor being driven by distributor shaft 10. Such capacitor comprises a rotatable plate 521 having protrusions 522 regularly spaced at the periphery of plate 521 and having a single fixed plate 523 connected to oscillator 525. Plate 521 is at ground potential since it is attached to shaft 10 which is grounded. Oscillator 525 provides a positive going signal output imposed upon junction 531 of logic circuit 530 whenever a protrusion 522 is driven past fixed plate 523. More details concerning this modulation method is available in U.S. Pat. No. 4,122,815 issued Oct. 31, 1978 which was incorporated by reference herein.

Logic circuit 530 has a bias resistor 532 connected between base of transistor Q5 at 531 and ground so as to maintain the base at ground potential until such time as a positive signal from oscillator 525 drives the base sufficiently positive to cause base current to flow and hence to cause collector current to flow and Q5 to conduct.

The emitter of Q5 has resistor 533 connected between it and ground, so that when junction 531 is at ground potential and no collector current flows, the Q5 emitter and junctions 45 and 75 will be at ground potential thereby maintaining Q2 and the Q s in their OFF states. When a positive going signal from oscillator 525 appears at junction 531 due to the oscillator being angularly modulated, the base of Q5 will be driven positive and base current will flow to cause Q5 to switch to its ON state, thereby raising the Q5 emitter and junctions 45 and 75 to a positive DC potential and causing Q2 to be switched to its ON state and the Q s to oscillate.

The following table expresses the logic performed by the FIG. 5 configuration:

| Oscillator 525 | Potential at Junction 531 | State of Q5 | Potential at Q5 Emitter | State of Q s | State of Q2 |
|---|---|---|---|---|---|
| not modulated | ground | OFF | ground | OFF | OFF |
| angularly modulated | positive | ON | positive | ON | ON |

A summary of the voltages and currents discussed above is given in the following table, showing verification of test results in the laboratory utilizing the circuits of FIGS. 1, 1*a*, 2 and 2*a*, as shown by such table.

| Parameter | FIGS. 1, 1a, 2, 2a without inductor 80 | FIGS. 1, 1a, 2, 2a with inductor 80 in circuit |
|---|---|---|
| i (peak-to-peak) | 6.7 amperes | 3 amperes |
| e (peak-to-peak) | 670 volts with very narrow time duration excursion of 1340 volts | 1500 volts |

What is claimed is:

1. An ignition system for a fuel powered engine, comprising the combination of:

an ignition transformer having a primary winding;

an AC power source having a coupling transformer, said coupling transformer having an output winding, said output winding being electrically coupled to said primary winding;

a capacitor, in series with said output winding and primary winding, said capacitor, output winding and primary winding constituting a series connected passive network devoid of arcing components.

electronic switching means, having an input circuit and an output circuit wherein said output circuit is connected in series with said passive network, for intermittently interrupting current flow in said passive network, said power source also being means for enabling current conduction through said switching means; and charge accumulation means, connected in series with said passive network and with the output circuit of said switching means, for accumulating charge provided by the power source and for delivering the accumulated charge to said primary winding, said charge accumulation means being an inductive component that is distinct from any one of said ignition transformer, coupling transformer and capacitor.

2. The ignition system as stated in claim 1, including timing means, connected to the output transformer of said power source and to the input circuit of said electronic switching means, for intermittently duty cycling said power source and triggering said switching means.

3. The ignition system as stated in claim 1, wherein said coupling transformer has a core of magnetizable material selected from the group consisting of cold rolled steel, relay steel, soft iron, silicon steel or alloys thereof.

4. The ignition system as stated in claim 1, wherein said charge accumulation means comprises an auxilliary transformer having first and second windings, said first winding being connected in series with said network and said second winding being fed by alternating current different from the alternating current provided by the power source.

5. The ignition system as stated in claim 1, wherein said coupling transformer has an additional output winding fed by alternating current which is different from the alternating current that is provided by the power source.

6. The ignition system as stated in claim 1, including:

logic means, coupled to the output transformer of said power source and to the input circuit of said switching means, for simultaneously providing bias to said power source and switching means; and trigger means, coupled to the logic means, for intermittently activating said logic means.

7. The ignition system as stated in claim 1, including logic means, coupled to the input circuit of said switching means and to the output transformer of said power source, for simultaneously activating and deactivating said switching means and power source.

8. The ignition system as stated in claim 1, wherein said switching means constitutes means for providing discrete separation between successive output waveforms during successive ignition periods of the system.

9. The invention as stated in claim 1, wherein said switching means comprises a Darlington circuit which increases the energy level in said ignition transformer.

10. The invention as stated in claim 1, wherein said power source has oscillatory stages and wherein said oscillatory stages comprise Darlington circuits.

11. The invention as stated in claim 1, wherein said system includes a direct current supply and wherein said switching means is conected between the direct current supply and the output winding.

* * * * *